United States Patent [19]

Janirek et al.

[11] 4,350,029

[45] Sep. 21, 1982

[54] APPARATUS FOR DE-FLESHING SKINS OR HIDES

[75] Inventors: Ladislav Janírek, Gottwaldov; Jaroslav Hlavinka, Kroměříž; Josef Hanáček; Zdeněk Mičulka, both of Otrokovice, all of Czechoslovakia

[73] Assignee: Strojosvit, Krnov, Czechoslovakia

[21] Appl. No.: 212,355

[22] Filed: Dec. 3, 1980

[30] Foreign Application Priority Data

Dec. 7, 1979 [CS] Czechoslovakia ..... 8538-79

[51] Int. Cl.[3] ..... C14B 1/00

[52] U.S. Cl. ..... 69/1

[58] Field of Search ..... 69/1, 22; 12/1 A

[56] References Cited

U.S. PATENT DOCUMENTS 2,704,932 3/1955 McIlvin et al. ..... 69/1

3,681,948 8/1972 Naarup et al. ..... 69/1

*Primary Examiner*—Patrick D. Lawson

[57] ABSTRACT

Two de-fleshing stations are interconnected by a transfer bridge. The first de-fleshing station feeds through its outlet chute, the rear end of the transfer bridge, while the second de-fleshing station feeds through its outlet chute, the rear end of the carry-away conveyor. The transfer bridge is provided with a pair of aligned endless conveyors which are selectively operable so that the hides can be selectively delivered from the first station to the second station, the carry-out conveyor or to an operator for manual handling.

4 Claims, 4 Drawing Figures

APPARATUS FOR DE-FLESHING SKINS OR HIDES

BACKGROUND OF THE INVENTION

The present invention is directed to a system for de-fleshing hides, skins or the like.

When de-fleshing skins or hides, the fatty and other particles are removed from the flesh side since they are undesirable for further operation in leather production. The skins or hides to be de-fleshed are in a swelled state, that means the mass of some species, e.g. cow hides, reaches 50 and more kg. Moreover, the surface of these hides is very slippery and thus manual handling of them is very laborious. Up to date de-fleshing is made entirely on a machine which consists of a knife roller, pressing rollers and a swinging-out supporting roller. When operating such a machine, the operators transfer the hide by the central part of its length over the supporting roller which is then swung into its closed position. In this position, the rotating knife roller begins to cut away the undesirable fatty and other particles from the flesh side of the hide. Simultaneously, the supporting roller together with the pressing rollers begins to shift the hide out from the machine. Thus, only the first half of the hide is treated requiring the operators to turn the hide, put it back again into the machine and treat the second half in the same way. It is obvious that this process of de-fleshing hides is very tedious and demands very hard work on the part of operators.

Apparatus is also known for de-fleshing hides which consists of two de-fleshing stations which are interconnected by a transfer bridge. The first de-fleshing station is attached through its outlet chute to the rear end of this transfer bridge, while the second de-fleshing station is attached through its outlet chute to the carry-out conveyor. Both the de-fleshing stations consist of standard de-fleshing machines as described above. The operators manually put the hide into the first de-fleshing station in such a way that only its first half is de-fleshed and thus treated, it falls through the outlet chute onto the transfer bridge. The hide is then led into the second de-fleshing station where its second half is de-fleshed falling through the outlet chute onto a carry-away conveyor. The arrangement removes the hard turning of hides, as well as the repeated insertion into the machine and final removal therefrom. This apparatus nonetheless has certain disadvantages in that it demands two relatively expensive de-fleshing machines which, in the event of failure of only one of them, requires the entire apparatus to be put out of operation. Thus, the technological procedure of pelt preparation and continuous supply of the subsequent workplaces for further treatment is undesirably interrupted. Another disadvantage is that one operator himself must control the closing movements of the supporting rollers of both the de-fleshing stations which, because the dimensions of the apparatus are relatively large, necessitate very careful and skilled operators.

These machines have been equipped with a timing member which senses the moment the supporting roller of the first de-fleshing station is closed and after some delay, which was previously set, the supporting roller of the second de-fleshing station is automatically closed. Since the treated hides have various dimensions, various time differences occur between hides as they fall from the outlet chute of the first de-fleshing station. As a result, the supporting roller of the second de-fleshing station does not close at the right moment every time and, thus, the second half of the hide is badly de-fleshed. Moreover, the outlet chute of the first de-fleshing station does not satisfy the conditions of controlled transition of the hide between the de-fleshing station and the transfer bridge. The swelled and slippery hide, in many cases, slides through the outlet chute in a non-controlled manner and falls down onto the transfer bridge in a variously bent mass of skin. In this state, the hide is not capable of being fed into the second de-fleshing machine. Therefore, to prevent the entire destruction of the hide and possible damage to the knife roller, the movement of the transfer bridge must be stopped. The continuous process is thus interrupted and the productivity of labour is decreased.

It is the object of the present invention to overcome the disadvantages of the prior art and to provide a simple apparatus and system by which de-fleshing of hides and the like can be accomplished in a more labor saving and economical manner.

SUMMARY OF THE PRESENT INVENTION

According to the present invention, the transfer bridge comprises two conveyors, the first of which has its front end set over the rear end of the second conveyor. The second conveyor is provided with an elevator device which permits swinging movement of its front end in a vertical plane between a position above a supporting roller of the second de-fleshing station and a position above the rear end of the carry-away conveyor. Both the conveyors of the transfer bridge and the carry-away conveyor are arranged on an individual chassis which is rolled on guide rails which lay in the direction of alignment of the stations.

Retaining spindles with resilient sheets are arranged at the outlet chutes of the de-fleshing stations to prevent free fall of the hides. A sensor for sensing the position of transported skin or hide is arranged on the transfer bridge, the sensor being connected through a device which determines the length of the skin or hide and through a device for timed shifting of the sensed information to a manifold distributor of pressurized fluid medium for operating an hydraulic actuator controlling the opening and closing movement of the supporting roller of the second de-fleshing station.

The higher technical effect and advantage of the apparatus, according to the present invention, lies in the selective swinging arrangement of the second conveyor of the transfer bridge which enables the front end of this second conveyor to be swung down above the rear end of the carry-away conveyor in the event the second de-fleshing station fails, which makes it then possible to entirely de-flesh the hides in the first station. The conveyors of the transfer bridge and the carry-away conveyor are individually mounted on a chassis enabling them to be handled simply and fast when adapting the apparatus. The resilient flaps of the retaining spindles control the right feeding of the hides through the outlet chutes. The sensor and evaluation of the length of the hides permits the supporting roller of the second de-fleshing station to reliably close at the precise moment necessary.

Full details of the present invention are set forth in the following disclosure and are shown in the accompanying drawings.

BRIEF DESCRIPTION OF THE DRAWINGS

The present invention is illustrated in the accompanying drawings, wherein.

DESCRIPTION OF THE INVENTION

Figure 1:
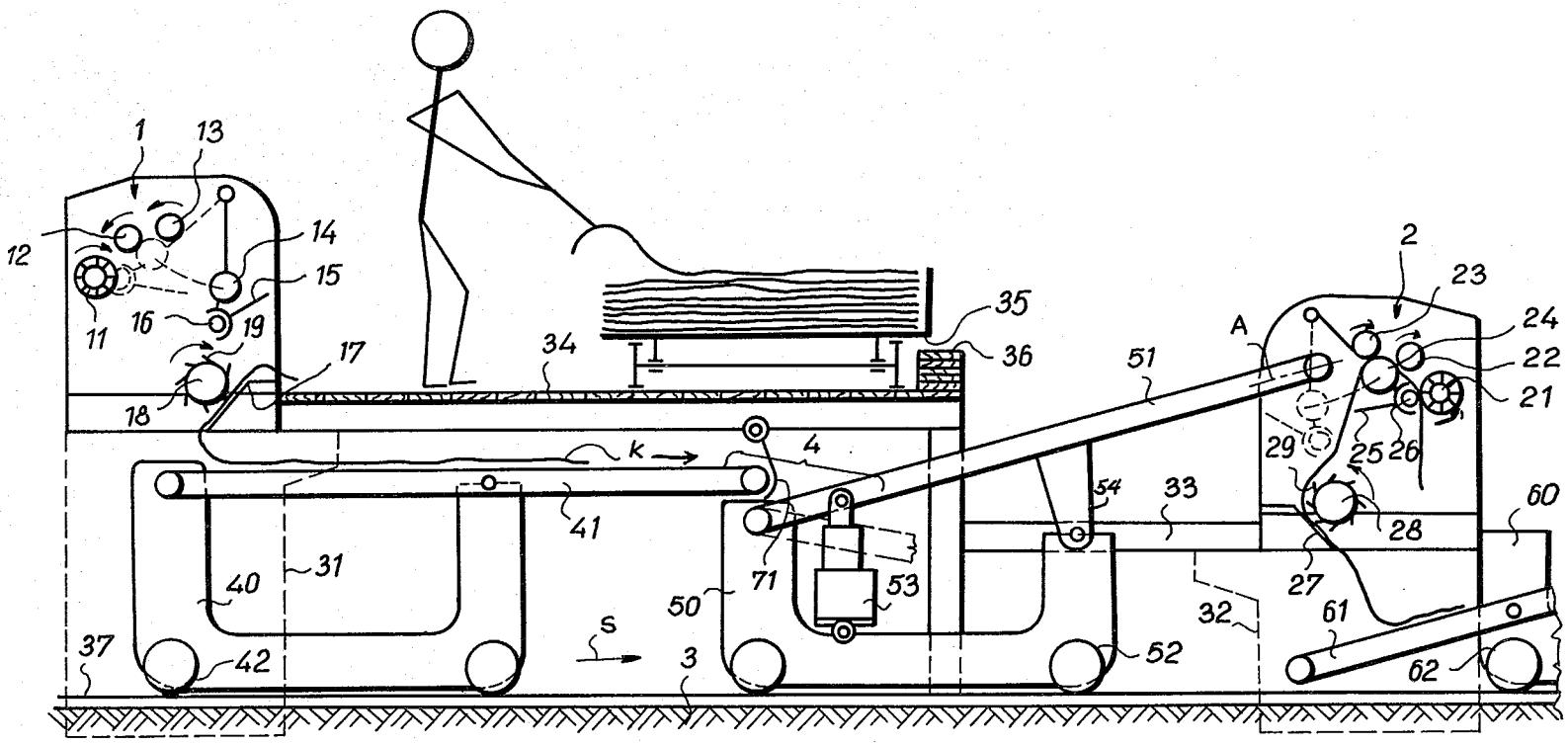
FIG. 1 is a side elevational view of the apparatus arranged for continuous de-fleshing of hides in two de-fleshing stations.
Figure 2:
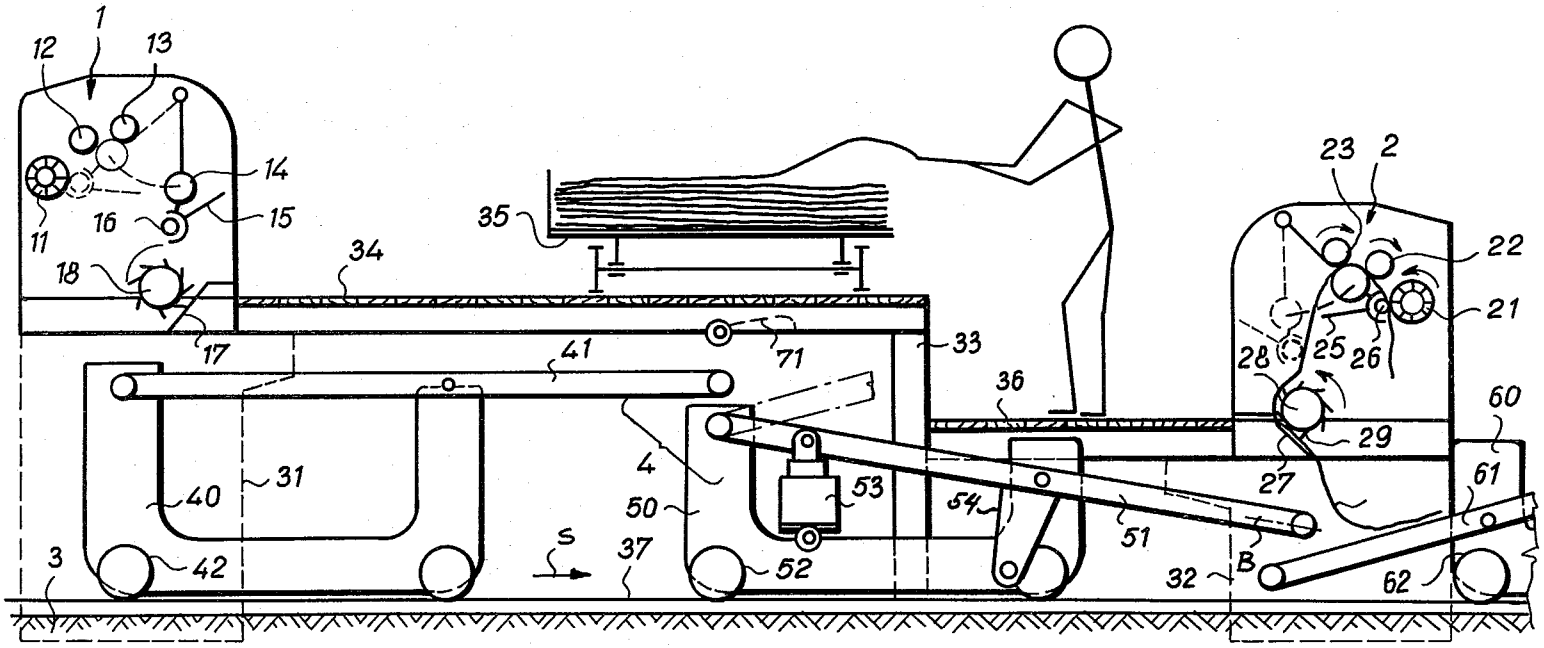
FIG. 2 is a similar view of the apparatus arranged for de-fleshing hides only in the second de-fleshing station.

As seen in the embodiment of FIG. 1, a pair of de-fleshing stations 1 and 2 are spaced from each other, in line. Each station is provided with a rotary knife 11, 21, a pair of pressing rollers 12, 13; 22, 23 and a supporting roller 14, 24. The supporting rollers 14, 24 are mounted at the end of an arm to pivotably swing into and out of operative engagement with the rollers 12, 13; 22, 23 respectively. In the open position (shown in full lines at station 1), the insertion of the hide K can be made between the support and pressing rollers, while in the closed position (shown in dotted lines at station 1), the hides are pressed and worked by the rollers. The support roller is shown in opposite full and dotted lines in station 2. Beneath each of the support roller 14, 24 is arranged a work table 14, 25 which terminates in a resilient cushion 16, 26. The work table 15, 25 and cushion 16, 26 are arranged to also swing simultaneously with the support rollers but into an out of pressing engagement with the surface of the rotary knife 11, 21 respectively, as seen in the positions of FIGS. 1 and 2. To this end, the table and cushions can be mounted on the same arm or bracket and be moved by same mechanism which mounts and moves the associated support rollers. At the bottom of each station, there is provided an outlet chute 17, 27, having an inclined plane, and a retention spindle 18, 28, provided with resilient flexible flaps 19, 29. The chute is arranged so that the hide falls on the conveyor properly oriented for the successive treatment at the next station. The direction of rotating the respective rotary knives, pressing rollers and retention spindles are shown by the arrows associated with each.

The construction of the de-fleshing station, i.e. the mounting and operation of the rollers, knives, etc., are conventional, and further details thereof are not believed necessary herein. If desired, reference can be made to: U.S. Pat. No. 3,911,703 (Silvio Repetto, Italy).

Both de-fleshing stations 1 and 2 are elevated above ground or floor level 3 by transversely spaced footings 31 and 32, and are connected by horizontal platforms 33 and 34. Station 1 is located a higher position than that of station 2 and platform 34 on which the operator primarily works, is provided with a deck permitting the operators to stand thereon, and allowing room for the hide to be recovered and handled.

The raw hide, to be de-fleshed, are supplied to the operator on a pallet 35 movable along the platform 34. Also seen in FIG. 1 on the platform 34 are a plurality of boards 36, stacked in readiness for use as the deck for the secondary work platform 33, as seen in the embodiment of FIGS. 2 and 3.

The two de-fleshing stations are interconnected by a transfer bridge comprising a first endless conveyor 41 and a second endless conveyor 51, set in line and tandem with each other. The front end of the first conveyor 41 is set to overlap the rear end of the second conveyor 51 and the rear end of the first conveyor lies beneath the outlet chute 17 of the station 1 so that the hides fall thereon. Beneath the chute 27 of the second de-fleshing station there is mounted a third endless conveyor 61 which can remove the hides worked thereon to a subsequent processing station. The first conveyor 41 is mounted on a movable chassis 40, the wheels 42 of which ride on rails 37 so as to be reciprocably movable in the direction S indicated by the arrow, which is also the direction of working of the hides. The second and third conveyors 51 and 61 are similarly mounted on chassis 50 and 60, the wheels 52, 62 of which also ride on the rails 37. The conveyors 41 and 51 are each pivoted at their rear ends to the respective chassis, which have a general U-shape as seen, and are supported along their length (generally midway) also by the chassis. The conveyor 51 is provided with a fluid lift device 53 (such as a piston and cylinder) which is operable to pivot the conveyor in the vertical plane so that its front end can be selectively positioned between extremes lying above (seen as A in FIG. 1) the support roller 24 of the second de-fleshing station 2, or below the de-fleshing station 2 entirely, and in proximity to the outlet conveyor 61 (as seen as B in FIG. 2). The conveyor 51 is provided with a mid-support 54 which is suitably linked to the chassis to permit the lifting and lowering of the conveyor while rendering support therefor.

Figure 3:
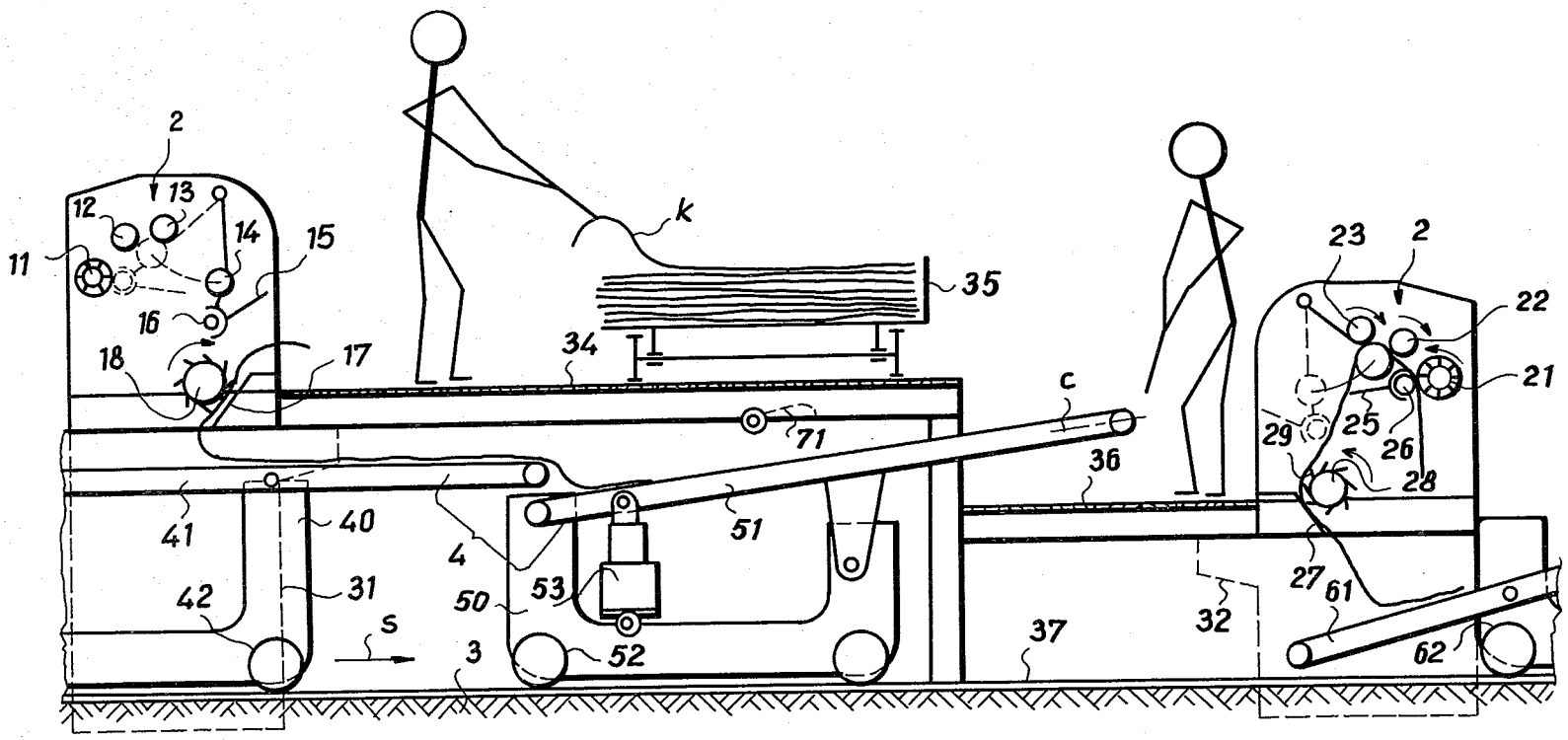
FIG. 3 is a similar view of the apparatus arranged for the individual manipulation of hides at both the de-fleshing stations, and, FIG. 4 is a circuit diagram of the sensor system employed in the apparatus of the present invention showing the control of the second de-fleshing station.

As a consequence of the ability to move both chassis 40 and 50, the respective conveyors can be located, as seen in FIG. 3, so that the front end of the second conveyor 51 can be lifted only partially, and will terminate above the pre-prepared deck 36 of platform 33 (as seen at C in FIG. 3) enabling an operator to manually handle the hides and feed the second station.

Figure 4:
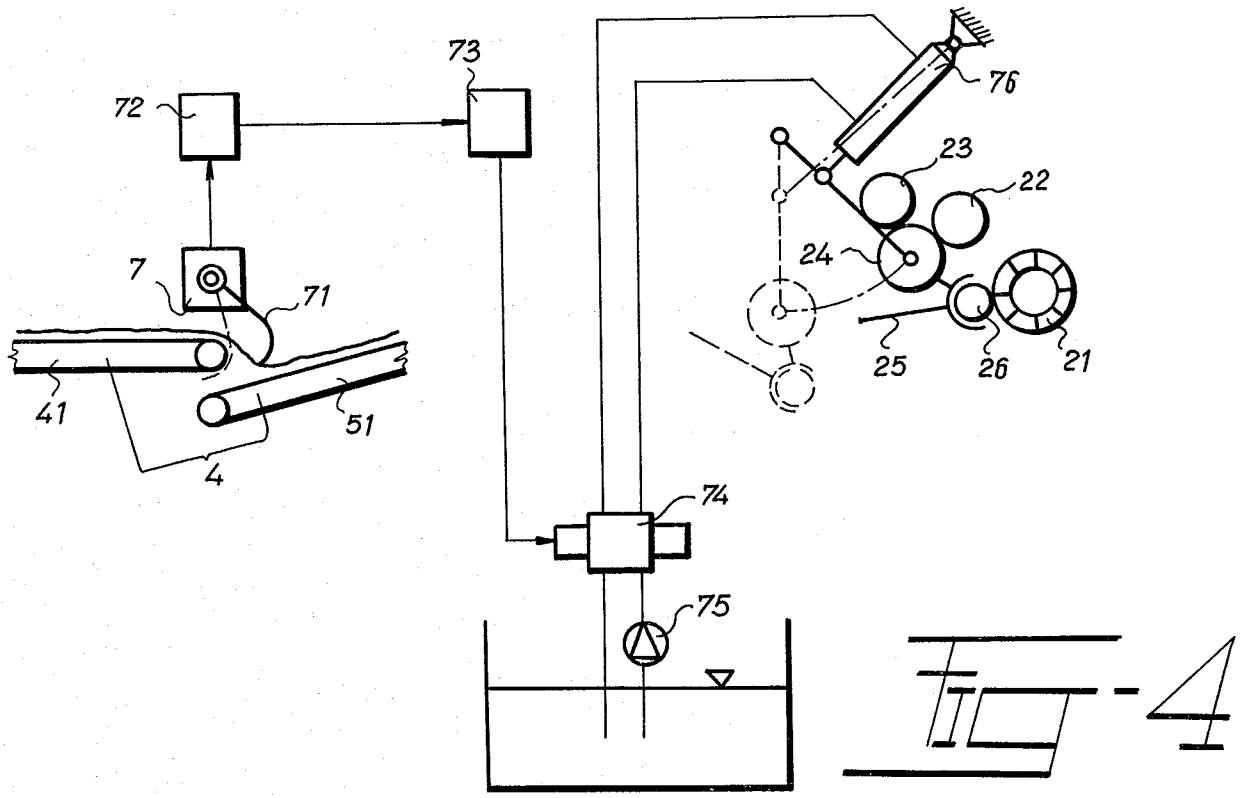

Mounted above the front end of the conveyor 41, preferably to the platform 34, is a sensor generally indicated by the numeral 7 which a curved finger 71 freely hanging therefrom and movable between an upper position (dotted line, FIG. 1) and a depending position adjacent the end of the conveyor 41 (full lines, FIG. 1). As seen in FIG. 4, the sensor 7 is connected to a signal generator 72 by which the length of the hide K is evaluated and connected into an electrical pulse or steady signal. The signal is passed to a time shifting device 73 which acts to delay its passage, and which subsequently controls suitable relay means which operates a fluid distributor valve 74 through which fluid pressurized from a source 75 can be made to flow to a hydraulic cylinder 76 effecting the opening and closing of the support roller 24 against the pressing rollers 22, 23 and the cushion 26 against knife 21 at the second station. The apparatus works as follows:

The operator stands on the platform 34 and step by step takes the hides K from the pallet 35 throwing them onto the work table 15 (wich is in its open handling position as seen in FIG. 1) with the flesh side up and then over supporting roller 14 (which is in its open position) of the first de-fleshing station 1 in such a way that at least the rear end of the hide K remains on the work table 15. Then, the operator starts (by non-illustrated control means) the device effecting the closing of the supporting roller 14 and simultaneously shifting the work table 15 with the resilient cushion 16 into the working position. The supporting roller 14 thus urges the hide K against both the pressing rollers 12, 13, which steadily rotate, and the resilient cushion 16, at the same time, pushes the hide K against the steadily rotating knife roller 11. The knife roller 11 thus starts to treat the first half of the hide K in the direction from about center of its length to its end and the pressing rollers 12, 13 together with the supporting roller 14 at the same time start to shift this partially treated hide K out from the first de-fleshing station 1. The hide K falls, due to its own gravity, over the supporting roller 14 onto the outlet chute 14, while the resilient flaps 19 of the rotating retention spindle 18 prevent the hide K from spontaneous slipping and thus, reliably laying the hide by its grain side onto the first conveyor 41 of the traffic bridge 4.

The hide K proceeds on the conveyor 41 in this state to the end of the conveyor where it contacts the swinging finger 71 which is pivoted, and starts the activity of the sensor device 72 for evaluation of the length. The sensor and signal generator firstly records the position of the front end of the non-treated half of the hide K so that after the entire hide is transfered and the swinging finger 71 returns into its original position, the entire length of the hide K is determined.

The hide K then proceeds further with the non-treated end first onto the second conveyor 51 (the front end of which is now elevated in the position A) until it finally starts falling onto the supporting roller 24 (which is now in its open position), and thence, between the open cushion 26 and the knife 21. At the moment when all the non-treated half of the hide K is safely beneath the level of the knife roller 21, which can and is determined due to the activity of the time shift device 73, the distributor 74 of the pressure medium is set into position in which the pressure cylinder 76 is caused to close the supporting roller 24 and shift the working table 25 into the working position. The direction of travel of the hide then reverses and the knife roller 21 starts treating the second half of the hide K. The pressing rollers 22, 23, together with the supporting roller 24 start to shift the hide K by the previously treated end rearwardly out from the second de-fleshing station 2.

The entirely de-fleshed hide K then rolls back over the supporting roller 24 onto the outlet chute 27 and by help of the resilient flaps 29 of the retaining spindle 28, is laid by its grain side up onto the carry away conveyor 61 which transports it to a further station for subsequent processing.

In the event either the first de-fleshing station 1 or the second de-fleshing station 2 fails, the second conveyor 21 of the transfer bridge 4 is swung down into the position B (FIG. 2), so that its front end is above the rear end of the carry-away conveyor 61. In this condition of the apparatus, the lifting device 53 on the chassis 50 is employed, and in addition, the individual chassis 40, 50, 60 of the conveyors are shifted according to need on the guide rails 37. Finally, the sensor 7 for sensing of the position of the transported hide is put out of operation.

In the event only the second de-fleshing station 2 fails, the operator remains on the working platform 34 and step by step treats both halves of each hide K in the first de-fleshing station 1 by first running the hide through a half treatment, reversing the hide and then running it through again for the other side. The entirely de-fleshed hides K are then sent through the outlet chute 17 onto the transfer bridge 4 and, subsequently, onto the carry-out conveyor 61 to any further processing operation.

The auxiliary deck adapted from the boards 36 serves to build up the platform 33 to enable the repairmen's simple approach to the second de-fleshing station as will be obvious from FIG. 2.

In the event of failure only of the first de-fleshing station 1, the motion of the entire transfer bridge is disconnected and the operator takes his place on the auxiliary deck made of the boards 36. The operator takes the hides from the pallet 35, from its opposite side (as seen in FIG. 2). Then, step by step, both halves of hide is treated in the second de-fleshing station 2 in the manner described above. The entirely de-fleshed hides K are, subsequently, fed through the outlet chute 27 directly onto the carry-away conveyor 61 to any further processing operation. The working platform 34 serves to enable the repairmen's simple approach to the first de-fleshing station 1, as well.

When the cause of the failure of the first or the second de-fleshing station is removed, the second conveyor 51 is re-set into the elevated position A and the hides are then continuously treated on both the de-fleshing stations 1 and 2.

For de-fleshing some hides (e.g. hides of non-standard measures and quality, hides of little batches, etc.), it is convenient to set the second conveyor 51 of the transfer bridge 4 into the intermediate position C (FIG. 3). In this arrangement, the sensor 7 is also placed out of operation. The operator of the first station 1 who stands on the platform 34, takes the hides K from the platform 35 and treat only their first half. The treated hides fall down through the outlet chute 17 onto the conveyor 41 and they turn automatically by their still not de-fleshed half into the direction to the second de-fleshing station 2. The operator who stands on the auxiliary platform 33 takes only the semi-treated hides K from the conveyor 41 (as seen in FIG. 3) and puts them into the second station 2 where de-fleshing operation is finished. The de-fleshed hides then fall down through the outlet chute 27 onto the carry-away conveyor 61. It is obvious that, also in this arrangement, a lot of hard labour of operators is removed when compared with the known method of de-fleshing hides on the single de-fleshing machine.

The apparatus, according to the present invention, can be used especially for de-fleshing hides or skins, but also for carrying out other leather-producing operations, where it is convenient to treat the hides or leathers by their halfs starting from center to each ends.

Various modifications, embodiments and changes have been disclosed herein; others will be obvious to those skilled in this art. Accordingly, it is to be understood that the present disclosure is to be taken as illustrated only and not limiting of the scope of the present invention.

What is claimed is:

1. A system for de-fleshing skins or hides, comprising two de-fleshing stations, each having a supporting roller for receiving and carrying said hide past knife means for de-fleshing the skin and to an outlet chute, said stations being interconnected by a transfer bridge, the first de-fleshing station being attached through its outlet chute to the rear end of the transfer bridge while the second de-fleshing station is attached through its outlet chute to the rear end of a carry away conveyor said transfer bridge comprising a pair of conveyors, the first of which is set so that its front end extends over the rear end of the second conveyor, said second conveyor being provided with a means for swinging the front end thereof in a vertical plane to assure a selected fixed condition between a position above the supporting roller of the second de-fleshing station and a position above the rear end of carry-away conveyor.

2. The system, according to claim 1, wherein both conveyors and the carry-away conveyor are arranged on individual chassis which are movable on guide rail arranged parallel to the direction of processing between the two stations.

3. The system, according to claim 1, wherein retaining spindles having resilient flaps are arranged along the outlet chutes of each of the de-fleshing stations to retard the falling of said hides.

4. The system, according to claim 1, including a sensor for sensing to position of the transported hide, said sensor being arranged on the transfer bridge, said sensor being adapted to provide a signal corresponding to the length of the hide and being connected through means for the time shifting of said signal, to a distributor of pressurized medium for actuating means controlling closing movement of the supporting roller of the second de-fleshing station.

* * * * *